US012479653B1

(12) United States Patent
Cormier

(10) Patent No.: US 12,479,653 B1
(45) Date of Patent: Nov. 25, 2025

(54) FIREWOOD STORAGE DEVICE COVER

(71) Applicant: Jeffrey Cormier, Paxton, MA (US)

(72) Inventor: Jeffrey Cormier, Paxton, MA (US)

( * ) Notice: Subject to any disclaimer, the term of this patent is extended or adjusted under 35 U.S.C. 154(b) by 0 days.

(21) Appl. No.: 19/040,972

(22) Filed: Jan. 30, 2025

(51) Int. Cl.
*B65D 90/06* (2006.01)
*B65D 88/12* (2006.01)

(52) U.S. Cl.
CPC ..... *B65D 90/06* (2013.01); *B65D 88/12* (2013.01); *B65D 2588/125* (2013.01)

(58) Field of Classification Search
CPC ..... A01K 97/06; B65D 2565/00–388; B65D 5/6673; B65D 90/06; B65D 88/12; B65D 2588/125
See application file for complete search history.

(56) References Cited

U.S. PATENT DOCUMENTS

2005/0023278 A1* 2/2005 Yong ..... B65D 90/046 220/1.6
2021/0403231 A1* 12/2021 Roberge-Gordon ..... D07B 1/14
2022/0042341 A1* 2/2022 Pancake ..... E04H 13/001
2022/0110424 A1* 4/2022 Rodgers ..... A45C 3/001

OTHER PUBLICATIONS

A screen shot of a IBC Anti-Static Dust Cover appearing on the ITP Packaging website, with an address of https://itppackaging.com/product/ibc-anti-static-dust-covers.

* cited by examiner

*Primary Examiner* — Kareen K Thomas
(74) *Attorney, Agent, or Firm* — Donald J. Ersler

(57) ABSTRACT

A firewood storage device cover preferably includes a top portion and a peripheral sidewall. The peripheral sidewall extends downward from an outer perimeter of the top portion. An inner peripheral surface of the peripheral sidewall is sized to receive a top portion of an outer perimeter of an IBC tubing frame. At least one eyelet is formed in each sidewall. A height of the peripheral sidewall is preferably about at least one fifth of a height of the IBC metal frame. The IBC metal frame includes a plurality of horizontal tubing rings, a plurality of vertical tubing members and a bottom plate. One end of a tensioning device is engaged with an eyelet in the peripheral sidewall. The other end of the tensioning device is hooked around one of the horizontal tubing rings in a stretched orientation to retain the firewood cover on the IBC tubing frame.

15 Claims, 2 Drawing Sheets

FIREWOOD STORAGE DEVICE COVER

BACKGROUND OF THE INVENTION

1. Field of the Invention

The present invention relates generally to the outdoor storage of firewood and more specifically to a firewood storage device cover, which protects firewood from getting wet during rain and snow storms, but allows the firewood to be aerated and subsequently "seasoned" (dehydrated).

2. Discussion of the Prior Art

The prior art discloses numerous ways to store firewood outdoors. One of the most common ways to store firewood outdoors is to place the firewood in an Intermediate Bulk Container (IBC container). The IBC container is primarily a metallic tubing frame, which holds a plastic bladder. However, the plastic bladder is removed. The firewood is then placed in the metallic tubing frame of the IBC container. However, the metallic tubing frame is open at the top and open on the sides. When it rains or snows, moisture penetrates a top layer of the firewood and impedes the seasoning of the wood.

Accordingly, there is a clearly felt need in the art for a firewood storage device cover, which protects firewood from getting wet during rain and snow storms, but allows the firewood to be aerated.

SUMMARY OF THE INVENTION

The present invention provides a firewood storage device cover, which protects firewood from getting wet during rain and snow storms. The firewood storage device cover (firewood cover) preferably includes a top portion and a peripheral sidewall. The peripheral sidewall extends downward from an outer perimeter of the top portion. The firewood cover is preferably made of a waterproof or water-resistant material, such as canvas. An inner perimeter surface of the peripheral sidewall is sized to receive a top portion of an outer perimeter of an IBC metallic tubing frame. At least one eyelet is formed in each sidewall. The eyelet is preferably fabricated from a metallic material, but other materials could also be used. A height of the peripheral sidewall is preferably about at least one fifth of a height of the IBC metal frame. The IBC metal frame includes a plurality of horizontal metallic tubing rings, a plurality of vertical metallic tubing members and a bottom plate. A bottom of the plurality of vertical members are welded to the bottom plate. The plurality of horizontal metallic tubing rings are welded to an outer surface of the plurality of vertical members along a height thereof.

A plurality of tensioning devices are used to retain the firewood cover over the IBC container. The tensioning device could be a bungee cord, a ratchet strap, rope, or any other suitable tensioning device. One end of the tensioning device is engaged with an eyelet in the peripheral sidewall. An opposing end of the tensioning device is hooked around one of the horizontal metallic tubing rings in a stretched orientation to retain the firewood cover on the IBC metallic tubing frame. A top and upper sides of a firewood stack will be protected from rain and snow. The rain and snow will contact only a side surface area of the firewood in the IBC metallic tubing frame, below the peripheral sidewall. In use, firewood is placed in the IBC metallic tubing frame and the firewood cover placed over a top of the IBC metallic tubing frame. The first and second hooks of the bungee cords are engaged with the plurality of eyelets and one of the horizontal metallic tubing rings.

Accordingly, it is an object of the present invention to provide a firewood storage device cover, which protects firewood from getting wet during rain and snow storms, but allows the firewood to be aerated.

These and additional objects, advantages, features and benefits of the present invention will become apparent from the following specification.

DETAILED DESCRIPTION OF THE PREFERRED EMBODIMENTS

Figure 1:
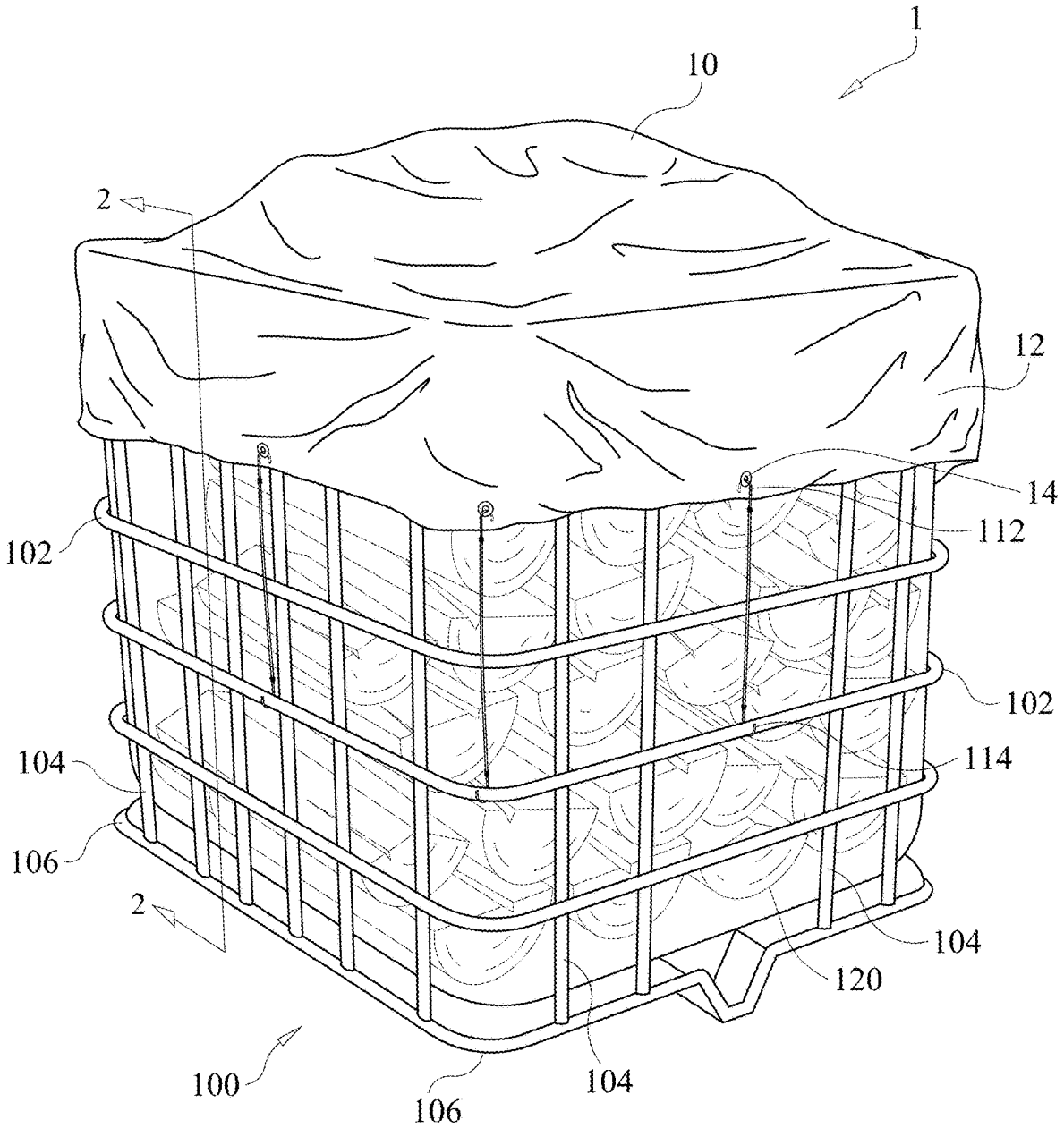
FIG. 1 is a perspective view of a firewood cover attached to a top of an IBC metallic tubing frame in accordance with the present invention.
Figures 2, 2A:
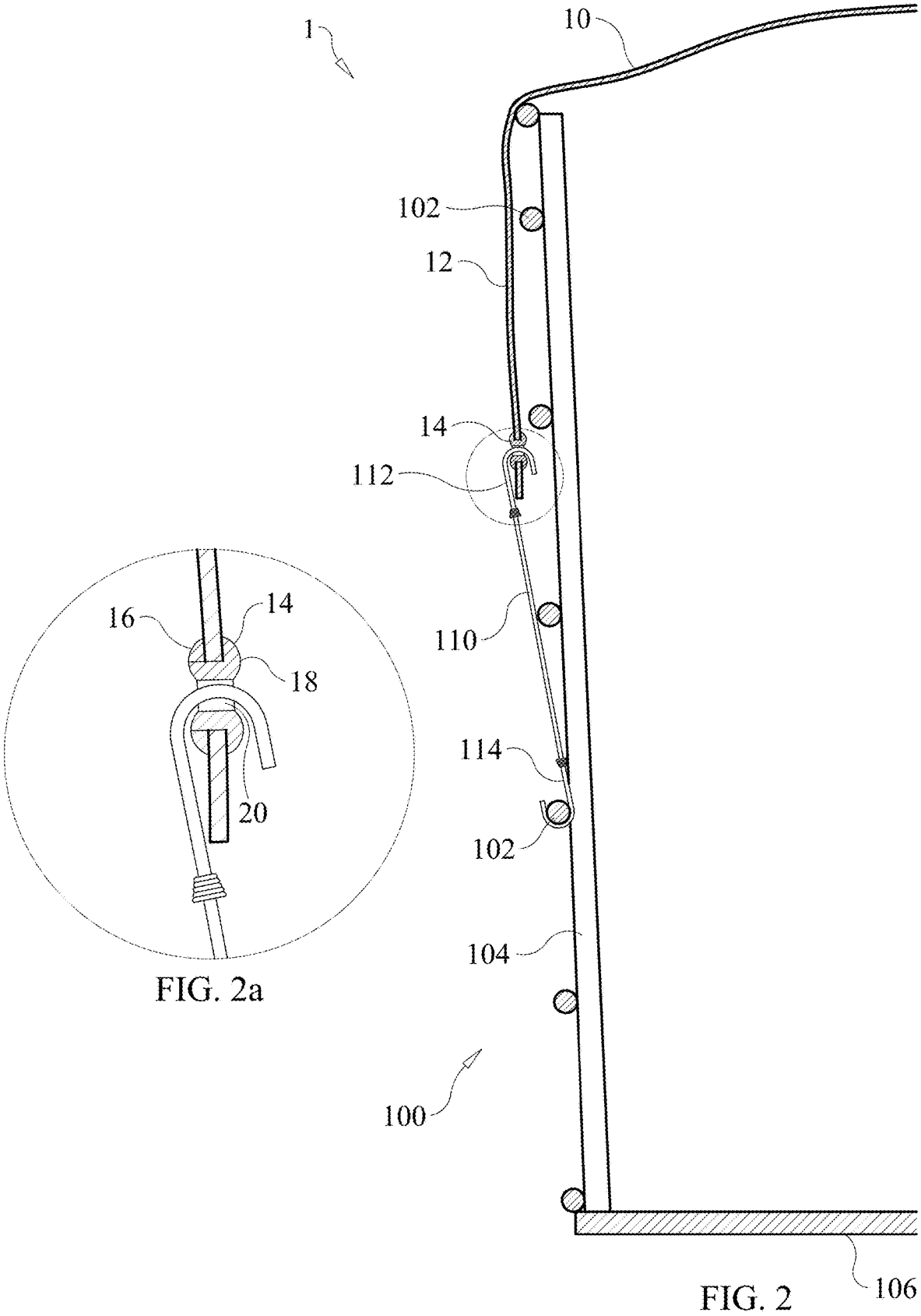
FIG. 2 is a cross sectional view of a firewood cover attached to a top of an IBC metallic tubing frame cut through FIG. 1 in accordance with the present invention.
FIG. 2*a* is an enlarged view of a bungee cord hook inserted through an eyelet of FIG. 2 of a firewood cover in accordance with the present invention.

With reference now to the drawings, and particularly to FIG. 1, there is shown a perspective view of firewood cover 1 secured to a top of an IBC metallic tubing frame 100. The firewood cover 1 preferably includes a top portion 10 and a peripheral sidewall 12. The peripheral sidewall 12 extends downward from an outer perimeter of the top portion 10. The firewood cover 1 is preferably made of a waterproof or water-resistant material, such as canvas. However, other waterproof or water-resistant materials may also be used. An inner peripheral surface of the peripheral sidewall 12 is sized to receive a top portion of an outer perimeter of an IBC metallic tubing frame 100. Preferably, one eyelet 14 is formed in each corner of the peripheral sidewall 12. However, at least one eyelet may also be formed in each side of the peripheral sidewall 12. The eyelet 14 preferably includes a first eyelet half 16 and a second eyelet half 18. The first and second eyelet halves 16, 18 are inserted into a hole in the peripheral sidewall and pressed together. Eyelets are well known in the art and need not be explained further detail. The eyelet 14 includes a through hole 20. The first and second eyelet halves 16, 18 are preferably fabricated from a metallic material, such as brass, but other materials could also be used.

A height of the peripheral sidewall 12 is preferably about at least one fifth of a height of the IBC metal frame 100. The IBC metal frame 100 includes a plurality of horizontal metallic tubing rings 102, a plurality of vertical metallic tubing members 104 and a bottom plate 106. A bottom of the plurality of vertical members 104 are welded to the bottom plate 106. The plurality of horizontal metallic tubing rings 102 are welded to an outer surface of the plurality of vertical members 104 along a height thereof.

A plurality of tensioning devices are used to retain the firewood cover 1 over the IBC container 100. The tensioning device could be a bungee cord 110, a ratchet strap, or any other suitable tensioning device. One end of the tensioning device is engaged with an eyelet in the peripheral sidewall. An opposing end of the tensioning device is hooked around one of the horizontal metallic tubing rings 102 in a stretched orientation to retain the firewood cover 1 on the IBC metallic tubing frame 100.

A first hook end 112 of the bungee cord 110 or the like is engaged with a single eyelet 14 in the peripheral sidewall 12. A second hook end 114 of the bungee cord 110 is hooked around one of the horizontal metallic tubing rings 102 in a stretched orientation to retain the firewood cover 1 on the IBC metallic tubing frame 100. A top of firewood 120 will be protected from rain and snow. The rain and snow will contact only a side surface area of the firewood 120, below the peripheral sidewall 12. In use, the firewood 120 is placed in the IBC metallic tubing frame 100 and the firewood cover 1 is placed over a top of the IBC metallic tubing frame 100. The hooks 112, 114 of bungee cords 110 are engaged with the plurality of eyelets 14 and one of the horizontal metallic tubing rings 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A firewood storage device cover for covering a top of a tubing frame of an IBC container, said firewood storage device cover is retained with at least four tensioning devices, comprising:

a top portion;

a peripheral sidewall extends downward from an outer perimeter of said top portion, an inner peripheral surface of said peripheral sidewall is sized to receive a top portion of an outer perimeter of the tubing frame, said peripheral sidewall is structured to cover less than a full height of all four sides of the tubing frame, a height of said peripheral side wall is less than half a height of the tubing frame to allow air flow through the tubing frame; and at least four eyelets are formed in the peripheral sidewall, each one of said at least one eyelet includes a through hole, which is sized to receive a hook of one of the at least four tensioning devices, said at least four eyelets are located on a bottom edge of said peripheral sidewall, said bottom edge is located above the half height of the tubing frame.

2. The firewood storage device cover of claim 1, wherein:

said firewood storage device is fabricated from a waterproof or water-resistant material.

3. The firewood storage device cover of claim 1, wherein:

said eyelet includes a first eyelet half and a second eyelet half, said first and second eyelet halves are pressed together to be retained in said peripheral sidewall.

4. The firewood storage device cover of claim 1, wherein:

said at least four eyelets are formed in each corner of said peripheral sidewall.

5. The firewood storage device cover of claim 1, wherein:

said at least four eyelets are formed in each side of said peripheral sidewall.

6. A firewood storage device cover for covering a top of a tubing frame of an IBC container, said firewood storage device cover is retained with at least four tensioning devices, comprising:

a top portion;

a peripheral sidewall extends downward from an outer perimeter of said top portion, an inner surface of said peripheral sidewall is sized to receive a top portion of an outer perimeter of the tubing frame, said peripheral sidewall is structured to cover a portion of all four sides of the tubing frame when secured to the tubing frame, a height of said peripheral side wall is less than half a height of the tubing frame to allow air flow through the tubing frame; and at least one eyelet is formed in each side of the peripheral sidewall, each one of said at least one eyelet includes a through hole, which is sized to receive a first hook of one of the at least four tensioning devices, wherein a second hook is secured to a horizontal ring of the tubing frame below said first hook, said at least one eyelet is located on a bottom edge of said peripheral sidewall, said bottom edge is located above a half height of the tubing frame.

7. The firewood storage device cover of claim 6, wherein:

said firewood storage device is fabricated from a waterproof or water-resistant material.

8. The firewood storage device cover of claim 6, wherein:

said eyelet includes a first eyelet half and a second eyelet half, said first and second eyelet halves are pressed together to be retained in said peripheral sidewall.

9. The firewood storage device cover of claim 6, wherein:

said at least four eyelets are formed in each corner of said peripheral sidewall.

10. The firewood storage device cover of claim 6, wherein:

said at least four eyelets are formed in each side of said peripheral sidewall.

11. A firewood storage device cover for covering a top of a tubing frame of an IBC container, comprising:

a top portion;

a peripheral sidewall extends downward from an outer perimeter of said top portion, an inner surface of said peripheral sidewall is sized to receive a top portion of an outer perimeter of the tubing frame, said peripheral sidewall is structured to cover all four sides of the tubing frame, a height of said peripheral side wall is less than half a height of the tubing frame to allow air flow through the tubing frame;

at least four tensioning devices each include a top hook and a bottom hook; and at least one eyelet is formed in each side of the peripheral sidewall, said at least one eyelet is located above the half height of the tubing frame, each one of said at least one eyelet includes a through hole, which is sized to receive said top hook, wherein said bottom hook is secured to a horizontal ring of the tubing frame, below said top hook.

12. The firewood storage device cover of claim 11, wherein:

said firewood storage device is fabricated from a waterproof or water-resistant material.

13. The firewood storage device cover of claim 11, wherein:

said eyelet includes a first eyelet half and a second eyelet half, said first and second eyelet halves are pressed together to be retained in said peripheral sidewall.

14. The firewood storage device cover of claim 11, wherein:

said at least four eyelets are formed in each corner of said peripheral sidewall.

15. The firewood storage device cover of claim 11, wherein:

said at least four eyelets are formed in each side of said peripheral sidewall.

* * * * *